United States Patent [19]

Bloom

[11] 3,981,522

[45] Sept. 21, 1976

[54] BOOK HOLDER

[75] Inventor: William Bloom, North Bergen, N.J.

[73] Assignee: Emjay Industries, Inc., Hoboken, N.J.

[22] Filed: May 28, 1975

[21] Appl. No.: 581,471

[52] U.S. Cl. ..... 281/34; 281/29; 281/36; 248/451; 248/465

[51] Int. Cl.[2] ..... B42D 3/04

[58] Field of Search ..... 281/33, 34, 42, 29, 281/31, 19; 248/451, 452, 453, 459, 460, 463, 464, 465

[56] References Cited

UNITED STATES PATENTS

| | | | |
|---|---|---|---|
| 515,687 | 2/1894 | Jeschke | 281/29 X |
| 1,784,736 | 12/1930 | Lear | 281/33 |
| 2,190,090 | 2/1940 | Tharp | 281/33 |
| 2,258,273 | 10/1941 | Barrett | 281/33 |
| 2,558,931 | 7/1951 | Chase | 281/33 |
| 3,215,450 | 11/1965 | Peterson et al. | 281/29 |
| 3,270,449 | 9/1966 | Robbie | 281/33 |

FOREIGN PATENTS OR APPLICATIONS

| | | | |
|---|---|---|---|
| 284,075 | 1/1928 | United Kingdom | 40/359 |
| 1,103,353 | 2/1968 | United Kingdom | 402/20 |
| 4,059 | 3/1900 | United Kingdom | 281/45 |

*Primary Examiner*—Jerome Schnall
*Attorney, Agent, or Firm*—Stoll and Stoll

[57] ABSTRACT

A book holder for enclosing and holding books, said book holder having a pair of cover panels, a back panel hingedly connected between said cover panels, book holding means on the cover panels, and a transverse spring element mounted in and across said cover and back panels, the spring element being normally extended in a generally straight line and in a generally common plane to support the book holder and a book held therein, in substantially flat, open position. The spring element is resiliently bendable transversely of its length to close the book holder and book held therein. A book holding strap is transversely disposed across the book holder, extending across a book held therein when the book holder and book are both in open position, said strap extending around the book holder when the latter and the book contained therein are in closed position. In the first mentioned (open) position, the strap holds the book open at the desired page; in the second mentioned (closed) position, the strap holds the book holder and book closed. The book holder is provided with a hingedly mounted strut which is adapted to support the book holder and book held therein in easel position for ease of reading.

3 Claims, 15 Drawing Figures

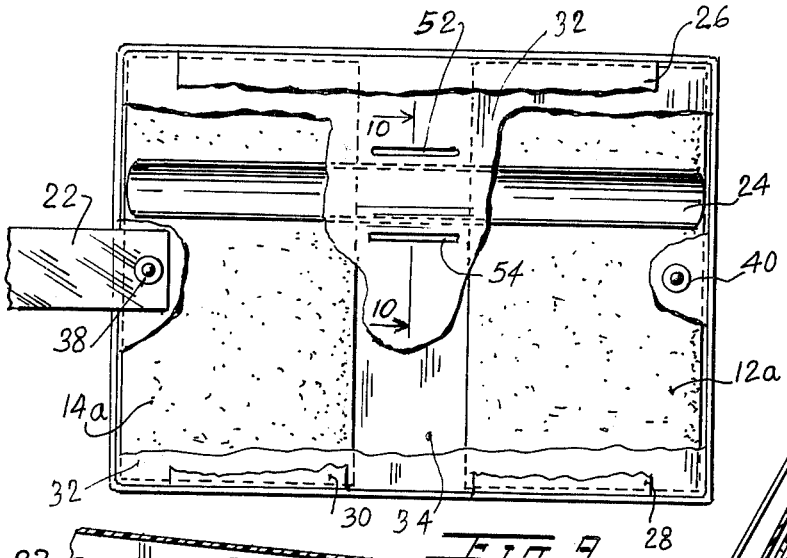
Fig. 9
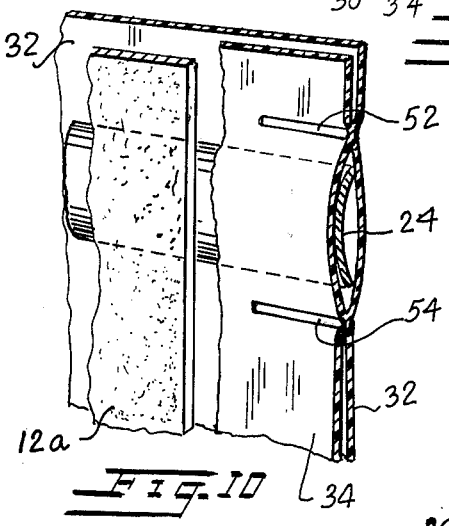
Fig. 10
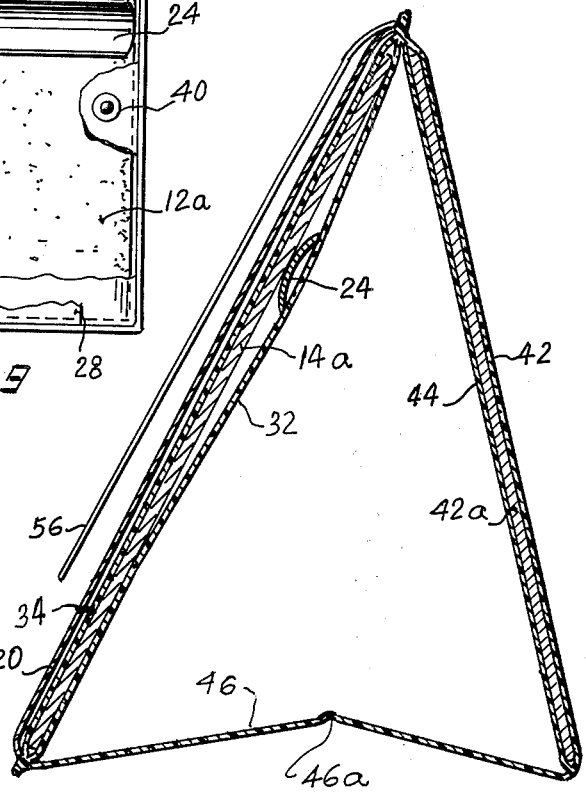
Fig. 7
Fig. 8
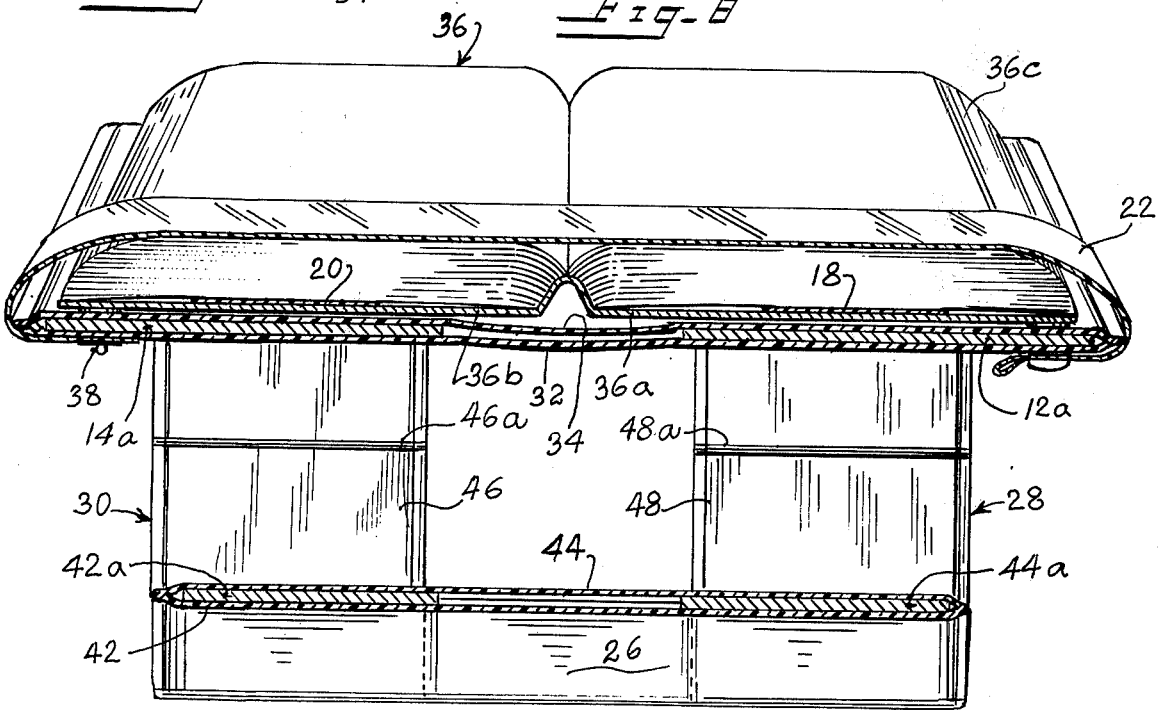

BOOK HOLDER

BACKGROUND OF INVENTION

1. Field of the Invention

This invention relates to book holders, sometimes called book covers, which are used to cover and protect the covers of a book.

2. Description of the Prior Art

The closest prior patent art known to applicant consists of the following U.S. Pat. Nos.:

3,128,108
3,339,875
3,367,679
3,747,889
3,785,605

While it is true that these prior patents disclose easel-type book holders, they do not disclose an easel-type book holder having the spring feature of the present invention. In none of the prior patents is provision made for spring means which functions to hold the book holder and book held therein in open position. In none of the prior patents is there any showing of a transverse book holder strap which is secured to the covers of the book holder, said strap being detachable from at least one of said covers and being adapted to be wrapped around the book holder and then detachably secured to the other cover in order to hold the book holder and book therein in closed position.

SUMMARY OF THE INVENTION

This invention comprises a book holder which may be mounted on the covers of a book to cover and protect same. It includes a pair of bands for securing the covers of the book to the covers of the book holder. It is provided with a transverse strap which is secured at its respective ends to the covers of the book holder and which is adapted to hold the book open at a given page. The transverse strap is detachable from one cover of the book holder and is attachable to the opposite cover of the book holder when the book holder and book therein are in closed position. In this arrangement the transverse strap is wrapped around the book holder in order to hold it and its book in closed position.

Hingedly secured to the back of the book holder is a strut which may be swung outwardly from the book holder to a predetermined angle to support the book holder and book contained therein in an easel position. Restraining means are provided to prevent the strut from swinging outwardly from the book holder beyond the pre-determined angle. Both the strut and its restraining means may be folded flat against the book holder when the easel arrangement is not in use, and they may also be folded with the book holder and book contained therein into closed position.

An important feature of the invention resides in the use of a transverse spring element which extends through the cover and back panels of the book holder. In its normal, unstressed condition the spring element extends in a substantially straight line and in a substantially common plane. It tends to maintain this position and it thereby tends to hold the book holder and book contained therein in open position. The spring element is bendable when the book holder and book contained therein are swung into closed position. In the preferred form of this invention, the spring element comprises an elongated strip, preferably made of spring metal and transversely curved along its entire length. When bent to close the book holder and book contained therein, the spring strip flattens cross-sectionally in the area in which it is bent.

BRIEF DESCRIPTION OF THE DRAWING

FIG. 7 is an enlarged vertical section showing the book holder and its supporting strut in easel position.

FIG. 8 is an enlarged horizontal section taken on the line 8—8 of FIG. 6, looking downwardly upon the easel-supported book holder and book mounted thereon.

FIG. 9 is a view similiar to that of FIG. 2 but showing the strut and outer wall of the book holder partially broken away to expose the spring element and stiffener boards of the device.

FIG. 10 is an enlarged, perspective, sectional view, partially broken away and taken on the line 10—10 of FIG. 9, showing the mounting of the spring element in relation to the inner and outer walls and stiffener boards of the device.

DESCRIPTION OF THE PREFERRED EMBODIMENT

Figure 1:
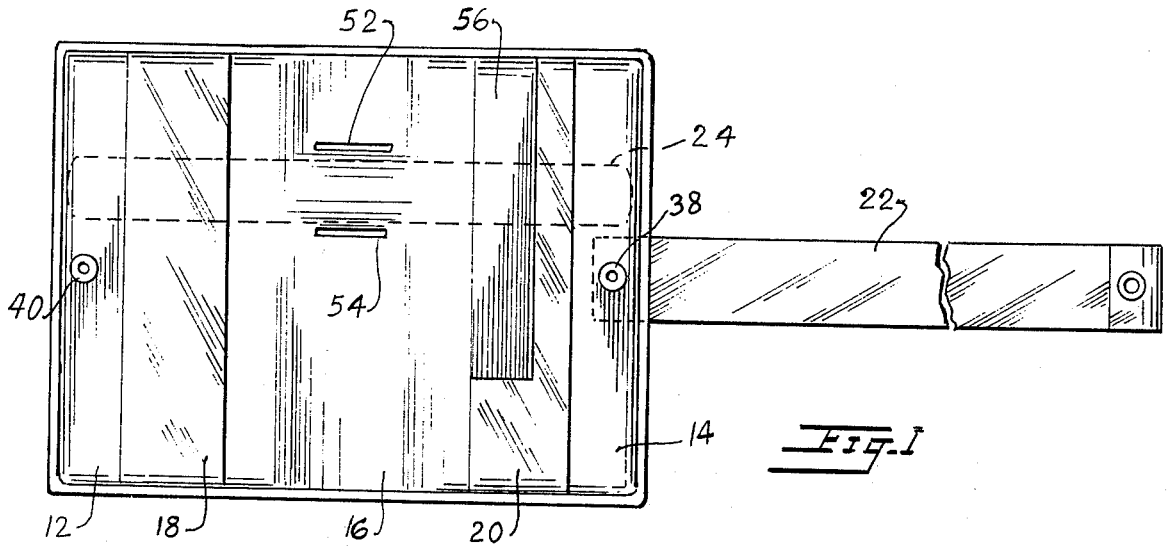
FIG. 1 is a plan view of a book holder made in accordance with the present invention, said book holder being shown in flat, open position, with its inner face exposed to view.
Figure 2:
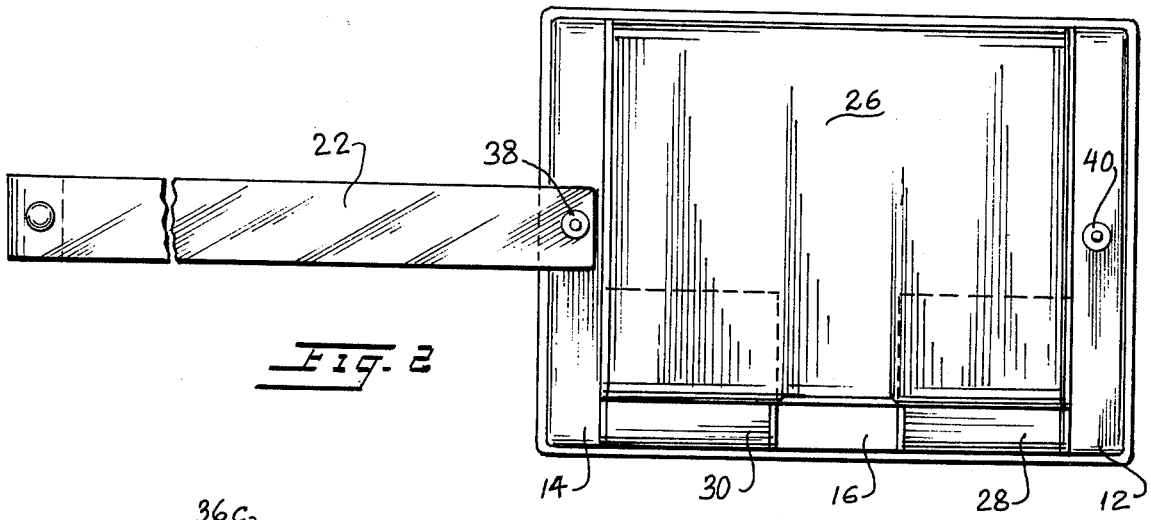
FIG. 2 is a plan view of the same book holder, also showing it in flat, open position, but with its outer face exposed to view.
Figure 3:
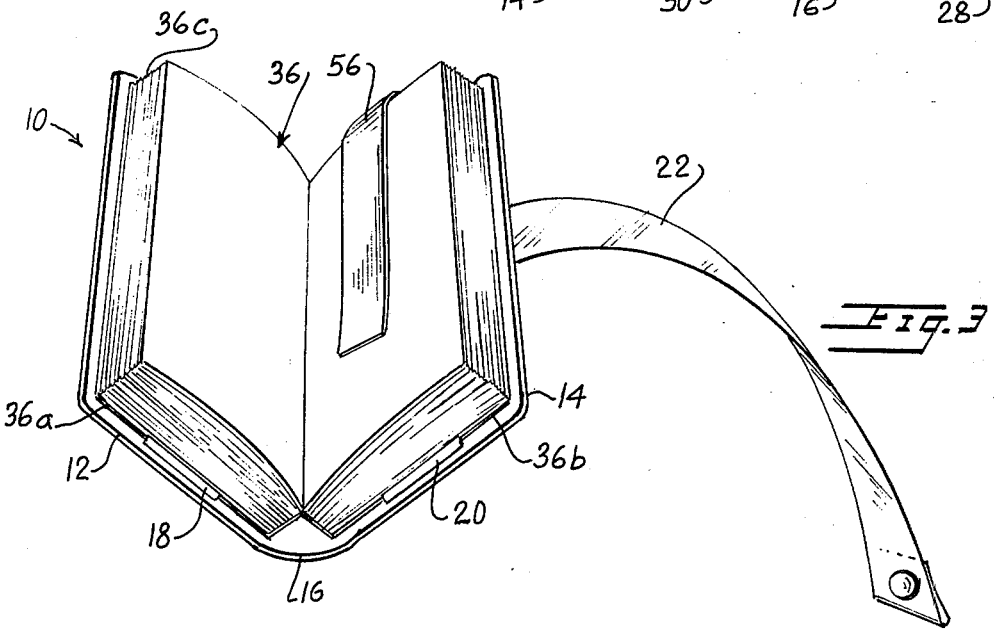
FIG. 3 is a perspective view of said book holder, showing a book mounted therein, said book holder and book being shown in partly open position.
Figure 4:
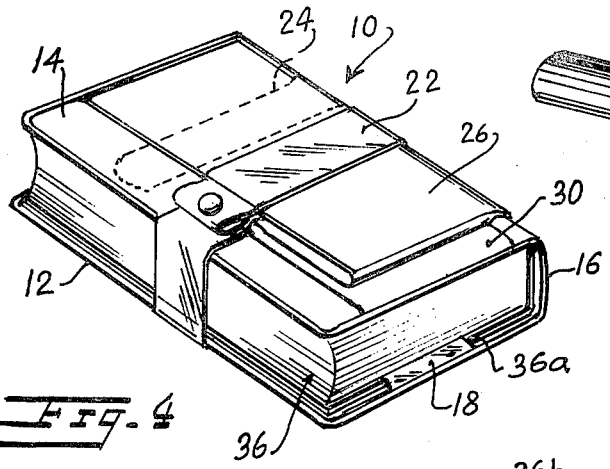
FIG. 4 is a perspective view of said book holder and book mounted therein, both shown in closed position.
Figure 11:
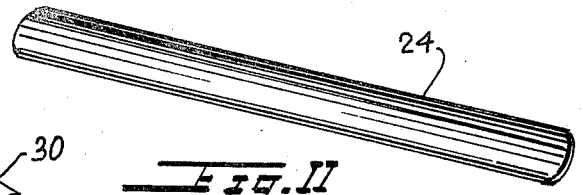
FIG. 11 is a perspective view of the spring element, showing it in unstressed position.
Figure 12:
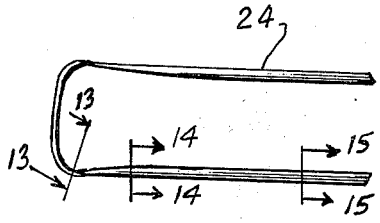
FIG. 12 is a view of the same spring element, showing it bent in the shape it would normally assume when the book holder and book mounted therein are both in closed position.
Figure 5:
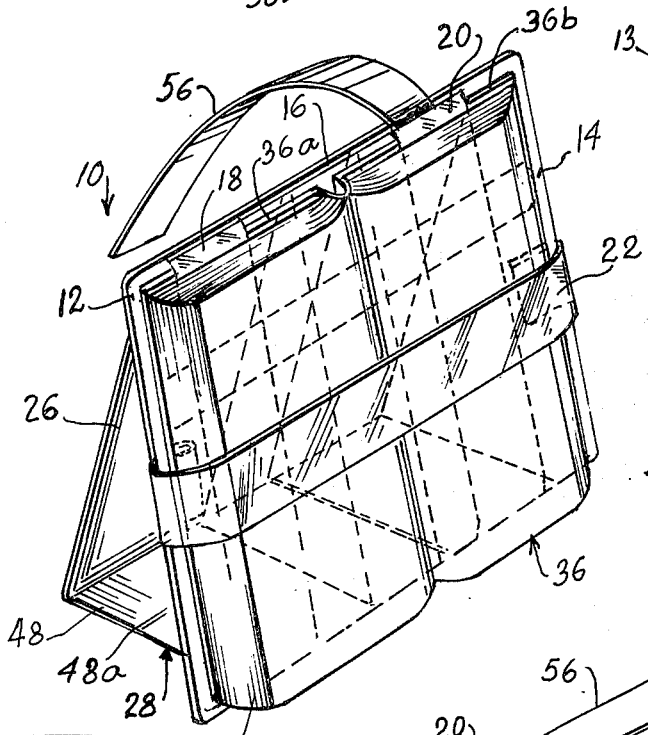
FIG. 5 is a perspective view of said book holder and book mounted thereon, said book holder and book being shown in fully open position for reading, the book holder being supported in easel fashion by means of a strut which extends outwardly therefrom at a predetermined angle.
Figures 13, 14, 15:
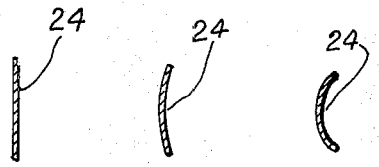
FIG. 13 is a transverse cross-section through said spring element, taken on the line 13—13 of FIG. 12.
FIG. 14 is a transverse cross-section through said spring element, taken on the line 14—14 of FIG. 12.
FIG. 15 is a transverse cross-section through said spring element, taken on the line 15—15 of FIG. 12.
Figure 6:
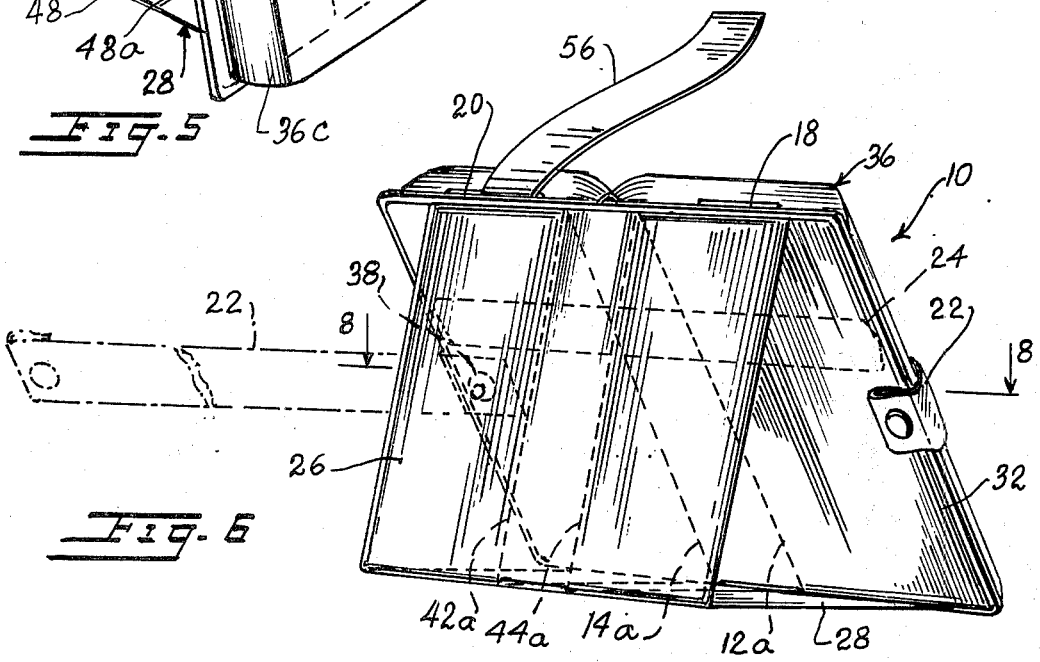
FIG. 6 is another perspective view of said book holder and book mounted thereon, the book holder being similarly supported in easel fashion, the view being taken from the back of the book holder and its supporting strut.

Referring now to the details of the invention as illustrated in the drawing, it will be seen that a book holder 10, made in accordance with the preferred form of this invention, comprises a pair of cover panels 12 and 14, a back panel 16, a pair of book-holding bands 18 and 20, an open page holding strap 22, a transverse spring element 24 mounted in said cover and back panels, a strut element 26, and a pair of strut restraining elements 28 and 30.

More specifically, the cover and back panels 12, 14, 16 comprise a pair of superposed plastic sheets 32, 34 which are heat-welded to each other along their respective edges and a pair of stiffener boards 12*a* and 14*a* mounted between the plastic sheets in spaced relation to each other. Stiffener boards 12*a* and 14*a* occupy those portions of the plastic sheets 32 and 34 which define cover panels 12 and 14. The plastic sheets, in the space between said stiffener boards, define back panel 16. The plastic sheets are sufficiently flexible to enable them to function as hinge connections between the back panel and the cover panels.

Bands 18 and 20 are heat sealed or welded at their upper and lower ends to the upper and lower ends of cover panels 12 and 14. It will be observed that when a book 36 is placed on the above-described book holder, the covers 36*a*, 36*b* of the book are slipped under bands 18 and 20, that is, between said bands and the cover panels of the book holder. It is by this means that the book is held in place on the book holder, the pages 36*c* of the book remaining free to be turned. The arrangement is such that opening the book holder opens the book, and closing the book holder closes the book. It will be seen that bands 18 and 20 are made of transparent sheet plastics so that printed matter will be legible through the bands.

Strap 22 extends transversely of the book holder, that is perpendicular to bands 18 and 20. One end of strap 22 is secured to cover panel 14 by means of snap fastener 38. The opposite end of strap 22 is secured to cover panel 12 by means of snap fastener 40. It will be understood that strap 22 will extend across the open pages of book 36 when the book and the book holder are both in open position. As is the case with bands 18 and 20, strap 22 is made of transparent sheet plastics so that the printed material on the open pages of the book will be legible through the stap.

One function of strap 22 is to hold the book open at selected pages. When it is desired to turn the pages this can readily be done by partially closing the book holder and thereby loosening the strap. Once the pages are turned, the book holder may be returned to fully open position, thereby tightening the strap across the open pages of the book.

Strap 22 has another function and that is to hold the book holder and book contained therein in closed position. This function may be performed in the following manner: One end of strap 22 is detached from the snap fastener to which it is connected, for example, fastener 40. The book cover and book are then closed. The strap is then wrapped around the closed book cover and the detached end of the strap is then attached to fastener 38. The book holder and book will now be retained in closed position.

Strut 26, like the cover and back panels of the book cover, is made of a pair of superposed plastic sheets 42 and 44 which are heat sealed or welded to each other along their respective edges. Confined between plastic sheets 42 and 44 is a pair of stiffener boards 42*a* and 44*a* and it will be observed that these boards, like stiffener boards 12*a* and 14*a*, are spaced from each other. Stiffener boards 42 and 44 provide the strut with adequate structural rigidity to support the book holder and book in easel fashion. In this connection it will be noted that the top edges of plastic sheets 42 and 44 are heat sealed or welded to the top edges of plastic sheets 32 and 34. In this manner the sheets of the strut are secured to the sheets of the cover and back panels and since these several plastic sheets are relatively flexible, a hinge connection is thereby formed between the strut and the cover and back panels.

In the use of the book holder herein described the strut may be swung flat against the cover and back panels and, when desired, the entire book holder, including the strut may be pivoted into closed position. This is rendered possible by the flexible sections of plastic sheets 32, 34 in the area between stiffener boards 12*a* and 14*a*, and by the flexible sections of plastic sheets 42 and 44 in the area between stiffener boards 42*a* and 44*a*.

When it is desired to use the book holder as an easel, strut 26 is swung outwardly from the cover and back panels to a predetermined angle, say 45 degrees. Restraining means are provided to prevent the strut from passing beyond the 45 degree angle. In the preferred form of this invention, the restraining means comprise a pair of bands 46, 48 which are made of flexible sheet plastics and they are heat sealed or welded at one end to the lower ends of plastic sheets 32, 34 and at their opposite end to the lower ends of plastic sheets 42, 44. Being flexible, these restraining bands 46, 48 are foldable on transverse fold line 46*a*, 48*a*. When the strut is moved to its outward position relative to cover panels 12, 14, restraining bands 46, 48 will unfold and restrain the strut from moving past the predetermined angle which it defines with the cover panels. When the strut is swung back into superposed position relative to said cover panels, the restraining bands will fold flat upon themselves between the strut on the one hand and the cover panels on the other hand.

An important feature of the invention will now be described, namely, spring element 24 which tends to hold the book holder and book held therein in open position. As will clearly be seen in the drawing, when unstressed, spring element 24 normally extends in a straight line and it is provided with a normally curved cross section throughout its entire length. Preferably this spring element is made of spring metal such as spring steel, but it may be made of other materials having sufficient resiliency.

Spring element 24 occupies space between outer plastic sheet 32 and stiffener boards 12*a*, 14*a*. As will be seen, spring element 24 extends transversely of the book holder, parallel to the upper and lower edges of said book holder. To confine the spring element in this position, a pair of heat seals or welds 52, 54 are formed between plastic sheets 32, 34 on opposite sides of the spring element and intermediate stiffening boards 12*a*, 14*a*.

In the use of the present invention, when the book holder and book contained therein are in open position, the spring element will tend to hold them in that position. When the covers of the book holder and book are pivoted to closed position, the spring element will flex in the vicinity of the back panel 16 of the book holder, its transverse curvature flattening out at least in that area. When the book holder and book are reopened, the spring element will spring back to its original extended position, thereby resuming its transverse curvature.

The present invention is susceptible of various modifications and additions which are within the skill of the art. For example, a page marker 56 may be provided to mark a selected page of the book held in the book holder. This book marker may comprise a narrow strip of flexible sheet plastics, heat sealed or welded at its upper end to the upper end of one of the cover panels of the book holder. Other variations and modifications are contemplated to the extent that they are encompassed within the broad scope and coverage of the appended claims.

I claim:

1. A bookholder, comprising:

a. a pair of cover panels, b. a back panel hingedly connected between said cover panels, c. book-holding means on said cover panels, and d. a spring element extending transversely of and mounted in said cover and back panels, e. said spring element being secured to said cover and back panels and normally extended in a generally common plane to support the book holder in a substantially flat, open position, f. said spring element being bendable transversely of its length when the book holder is closed, g. said spring element comprising a resilient strip formed with a transverse curve along its length to provide it with structural stiffness and to keep it in extended position, h. whereby the book holder is held in open position, i. said resilient strip being transversely bendable to flatten its transverse curve when the book holder is closed, j. the book-holding means comprising a pair of book-holding bands which are secured at their upper ends to the upper ends of the cover panels and which are secured at their lower ends to the lower ends of the cover panels, k. said book-holding bands and said cover panels forming pockets between them which are adapted to receive and hold the covers of a book, whereby the book is held in place on said book holder, l. a strut provided on the back of the cover and back panels to support them in easel fashion, m. said strut being hingedly connected at its upper end to the upper ends of said cover and back panels, n. restraining means interconnecting the lower end of said strut with the lower ends of said cover panels, o. said restraining means being foldable to enable the strut to swing to a position substantially flat against the cover and back panels, p. said strut being formed of a pair of superposed flexible plastic sheets which are joined along their respective edges and are provided with a pair of spaced stiffener boards between them, q. whereby the strut is structurally capable of supporting the book holder and a book held thereon, in easel fashion, r. said strut being foldable in the space between its stiffener boards to coincide with the hinging action between the back and cover panels, s. a book-holding strap transversely disposed across the book holder, t. means securing one end of said book-holding strap to one cover panel adjacent its outer side edge, and u. means securing the opposite end of said book-holding strap to the other cover panel adjacent its outer side edge, v. said book-holding strap being adapted to hold a book on the book holder.

2. A book holder in accordance with claim 1, wherein:

a. the cover and back panels comprise a pair of superposed flexible plastic sheets which are joined along their respective edges and are provided with a pair of spaced boards between them, b. said boards providing the cover panels with structural stiffness to support the covers of a book, c. said plastic sheets, in the space between the boards, defining the back panel and having the property of flexibility for hingedly converting said back panel to said cover panels.

3. A book holder in accordance with claim 1, wherein:

a. the means which secures one end of the book-holding strap to one of the cover panels is a snap fastener, b. a second snap fastener being provided on the other cover panel, c. whereby said strap may be detached from said first mentioned fastener and, when the book holder and book held therein are both closed, said strap may be wrapped around the book holder and secured to said second mentioned fastener, d. thereby holding the book holder and book therein in closed position.

* * * * *